United States Patent [19]

Maveety

[11] Patent Number: 5,054,299

[45] Date of Patent: Oct. 8, 1991

[54] JEWELRY, WITHOUT FASTENERS, FORMED BY THE WEARER BY BENDING FROM A PLANAR CONFIGURATION INTO CIRCULAR AND/OR OTHER CONFIGURATIONS TO BE WORN AS A NECKLACE, BRACELET, BELT, ETC, AND REFORMED MANY TIMES TO SERVE AS THE SAME OR OTHER JEWELRY

[76] Inventor: Susan C. Maveety, 9905 157th St. E., Puyallup, Wash. 98373

[21] Appl. No.: 486,249

[22] Filed: Feb. 28, 1990

[51] Int. Cl.[5] ..... A44C 5/00

[52] U.S. Cl. ..... 63/3; 63/2; 63/11; 63/DIG. 3

[58] Field of Search ..... 63/2, 3, 11, DIG. 3

[56] References Cited

U.S. PATENT DOCUMENTS

| | | | |
|---|---|---|---|
| 1,197,322 | 9/1916 | Wolf | 63/2 |
| 1,978,168 | 10/1934 | Reid | 63/3 |
| 2,189,096 | 2/1940 | Alonge | 63/29.1 X |
| 2,266,942 | 12/1941 | Wallace | 63/3 X |
| 2,282,336 | 5/1942 | Meyer | 63/11 X |
| 2,771,768 | 11/1956 | Tudor | 63/3 X |
| 2,833,128 | 5/1958 | Del Noce | 63/3 |
| 2,898,602 | 8/1959 | Moss | 63/3 X |
| 4,301,669 | 11/1981 | Wilcox | 63/3 X |
| 4,753,068 | 6/1988 | Schmidt | 63/3 |

FOREIGN PATENT DOCUMENTS

| | | | |
|---|---|---|---|
| 1069737 | 7/1954 | France | 63/3 |
| 216750 | 9/1941 | Switzerland | 63/2 |

*Primary Examiner*—Laurie K. Cranmer

*Attorney, Agent, or Firm*—Roy E. Mattern, Jr.

[57] ABSTRACT

Jewelry, having no fasteners, is made initially in a planar form of a molded rubber or a molded rubber-like plastic material, having, essentially throughout a central portion thereof, bendable metal. This bendable metal is preferably composed of one or more readily bendable wires, such as hay bailing wire. The ends of the wire are preferably folded back to create overall blunt end portions of these wires. The bendable metal, when bent to a desired configuration, stays in that configuration, until changed by the wearer of this bendable jewelry. The exterior of the metal when covered by the moldable material remains well below the surfaces of the moldable material. The bendable metal has a high fatigue life. This bendable jewelry, so made, is conveniently manipulated and worn by all persons, and especially by children, and also especially by arthritic persons of all ages.

15 Claims, 4 Drawing Sheets

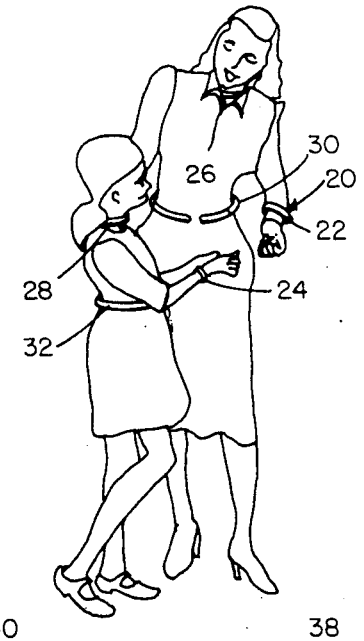
FIG. 1
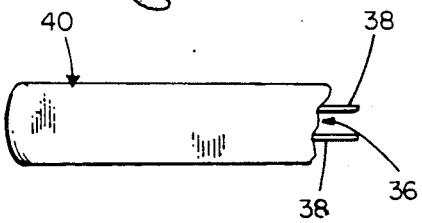
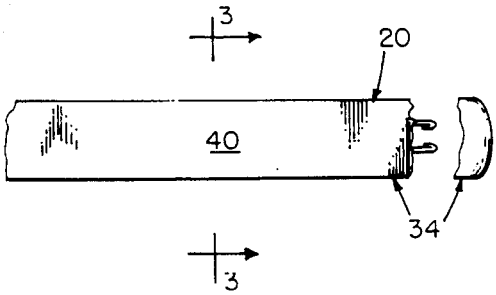
FIG. 2
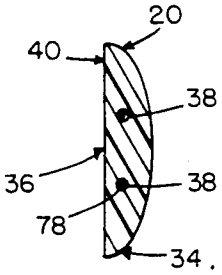
FIG. 3
FIG. 4
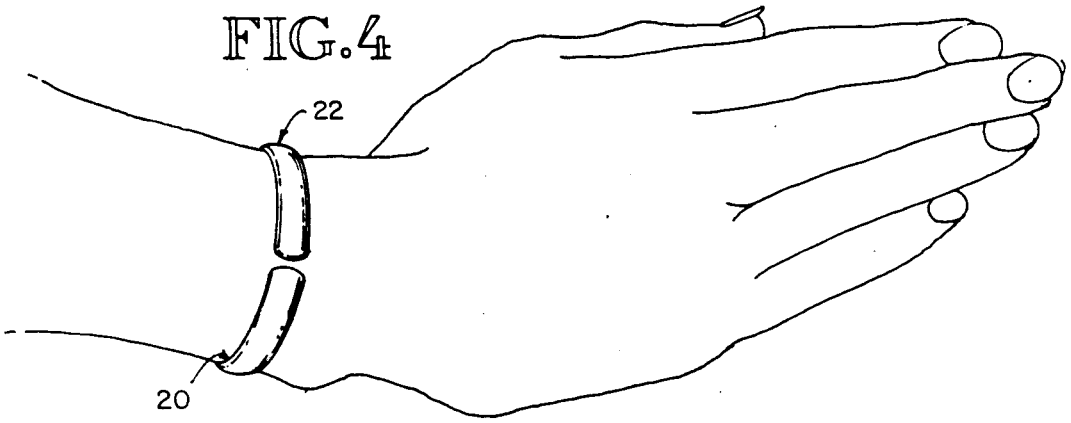

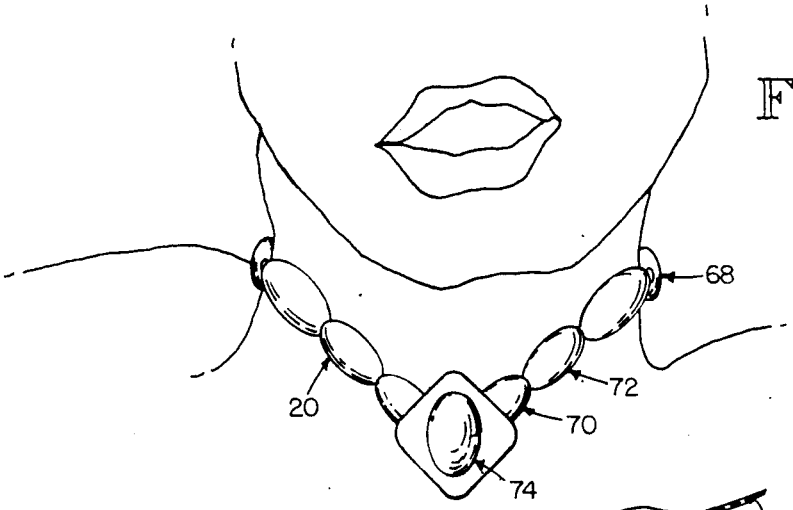
FIG. 15
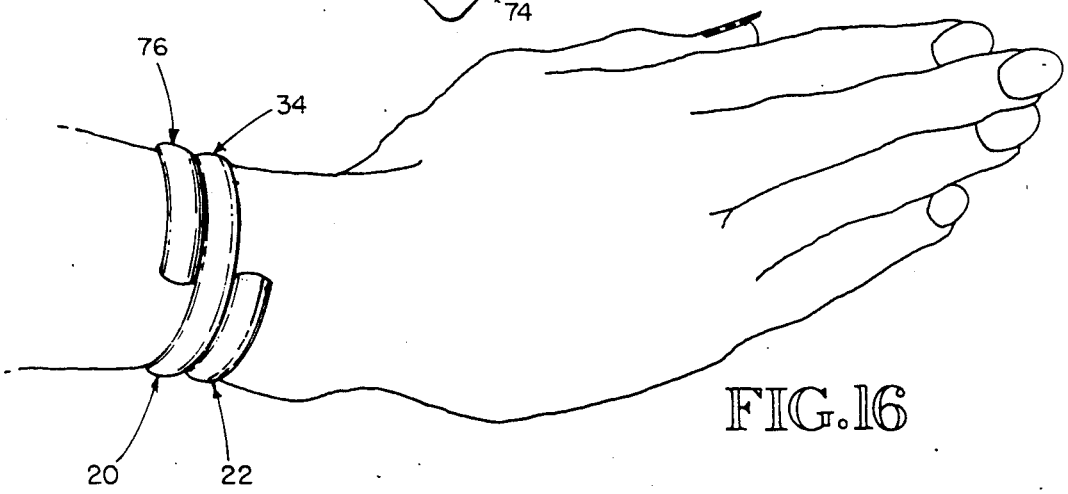
FIG. 16
FIG. 17
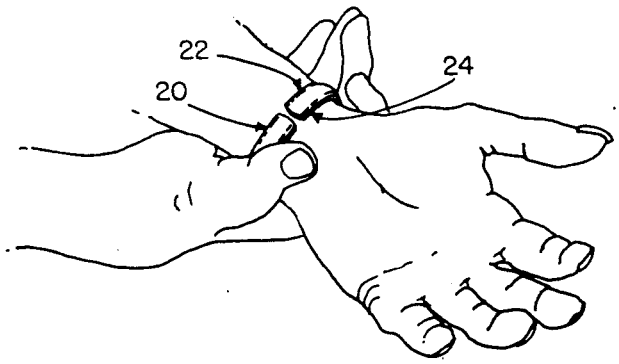

JEWELRY, WITHOUT FASTENERS, FORMED BY THE WEARER BY BENDING FROM A PLANAR CONFIGURATION INTO CIRCULAR AND/OR OTHER CONFIGURATIONS TO BE WORN AS A NECKLACE, BRACELET, BELT, ETC, AND REFORMED MANY TIMES TO SERVE AS THE SAME OR OTHER JEWELRY

BACKGROUND

Jewelry to be fitted about portions of a person's body which is available today is generally made for a specific purpose and so formed initially to be fitted about a specific body portion, when respective ends thereof are secured together by tying or by manipulating fasteners. Small children need the assistance of parents to put on and take off such jewelry. Most arthritic persons have difficulty in putting on and taking off such jewelry and many arthritic persons need the help of other persons. Moreover, arthritic persons having children or grandchildren to care for are often not able to assist their children or grandchildren in putting on or taking off the children's jewelry.

Yet these children and arthritic persons have the desire to wear jewelry, which they themselves, without the assistance of other persons, may put on and take off, and when worn, the jewelry will stay in its original place about one's wrist, neck, or waist, and be enjoyable and desirable to wear.

SUMMARY

Comfortable, safe, simple, pliable, colorful, fashionable jewelry, which stays in place, is conveniently put on and taken off by all persons, and especially, by children and by arthritic persons, by themselves without the assistance of other persons. In a basic embodiment, a planar elongated bendable metal of long fatigue life, is, during manufacture, surrounded by a moldable material, such as rubber, or a rubber-like plastic. This bendable metal is preferably composed of one or more readily bendable wires, such as hay bailing wire. The ends of the wire are preferably folded back to create overall blunt end portions of these wires. The overall length may be short enough to be formed in a circle about a person's wrist to serve as a bracelet, or made longer to serve as a necklace, or made longer to serve as a belt. Other embodiments are derived by twisting, braiding and/or weaving multiple basic embodiments. Other items are molded into the embodiments such as watches, ornaments, and jewels. The moldable material is selectably colored. From the basic embodiment to the most complex embodiment, all these embodiments serve as desired jewelry, to be conveniently put on and taken off by all persons, by themselves, for there are no fasteners to be manipulated, and this bendable jewelry stays on where it is placed.

DRAWINGS

This bendable jewelry, not needing fasteners, and put on and removed by all persons, by themselves, is illustrated in the drawings, wherein:

FIG. 1 illustrates a mother and her child who are both wearing a bendable bracelet, a bendable necklace, and a bendable belt, which are embodiments of this bendable jewelry;

FIG. 2 shows the bendable bracelet in a planar configuration as it appears at the conclusion of its manufacture, and portions are removed to indicate how spaced wires, serving as the bendable metal occupy space in the central portions of this bracelet, and the moldable rubber or rubber-like plastic material surrounds the bendable metal to complete this basic embodiment of the bendable jewelry, which could use only one wire, or more wires;

FIG. 3 illustrates the cross section, taken on line 3—3, of FIG. 2, of the bendable bracelet shown in FIG. 2;

FIG. 4 shows how this bendable bracelet has been formed into a circle to fit about a person's wrist;

FIG. 15 shows a necklace formed to represent beads and also having a jewel molded in place;

FIG. 1 illustrates how a necklace by making two wrap arounds is being formed into a bracelet; and FIG. 1 shows how a person with less dexterity in one's fingers, caused by rheumatoid arthritis easily puts on a bracelet.

DESCRIPTION OF PREFERRED EMBODIMENTS

Figure 5:
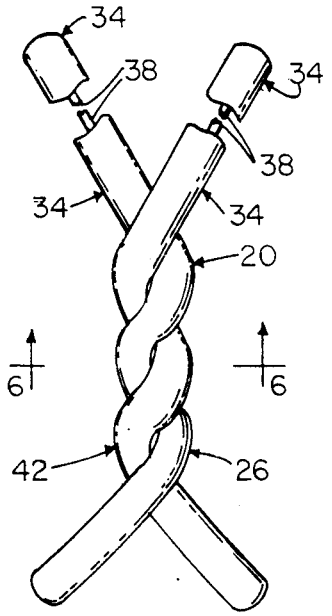
FIG. 5 illustrates the making of a bendable necklace in a planar configuration, as two basic embodiments are being twisted about one another, indicating how in this embodiment one wire is used in each basic embodiment.

In the drawings several selected embodiments are illustrated of this bendable jewelry, having no fasteners, and easily manipulated by all persons, even those lacking dexterity in their fingers and hands, giving them the opportunity to create and to enjoy many styles of jewelry with ease, comfort, and fashion. This bendable jewelry is simple, safe, pliable, non toxic, colorful, readily cleaned, essentially non breakable, and reusable and reformable, taken off and put on, for many wearing times.

Basic embodiments are added together by twisting, braiding, and weaving giving a person the fun of creating jewelry. Small children, elderly persons, arthritic persons and disabled persons, without seeking help from other persons, create, put on, and take off this bendable jewelry, giving them their independence in their joy of wearing jewelry.

How this bendable jewelry 20, is worn is illustrated in FIG. 1, both a mother and her child are respectively wearing a bendable bracelet 22, 24, a bendable necklace 26, 28, and a bendable belt 30, 32. Each of these bracelets, necklaces, and belts embody the basic embodiment components, in respective sizes, as shown in FIG. 2. At the conclusion of the manufacture of this bendable jewelry 20, a basic embodiment 34 is in a planar configuration, as shown in FIG. 2. Throughout essentially all the length of the central portion 36 of the basic embodiment 34 is bendable metal 37, as shown in FIGS. 2 and 3. This bendable metal 37 is preferably composed of one or more wires 38, having folded end portions 39, creating overall blunt end portions which will not tend to otherwise pierce the rubber material 40. Such wire is hay bailing wire 38. Completely surrounding and protecting the bendable metal 37 is a moldable rubber or rubber-like plastic material 40, as shown in all the figures. The bendable metal 37 has a long fatigue and strong life, and when bent to a selected form, so remains, until being straightened and/or re-bent to the same or another configuration. This basic embodiment 34 formed in a wrist size to serve as a bendable bracelet as illustrated in FIG. 4. One, two, or more, wires 38 may be used in a basic embodiment 34.

Figure 6:
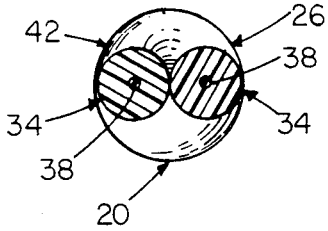
FIG. 6 shows the cross-section taken on line 6—6 of FIG. 5, of the bendable necklace shown in FIG. 5 as it is being made.
Figure 7:
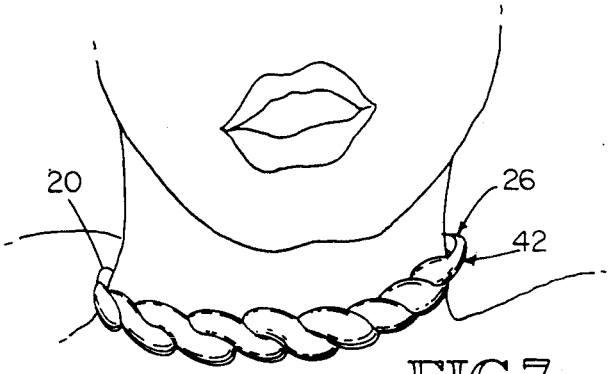
FIG. 7 illustrates how this bendable necklace of FIGS. 5 and 6 has been formed into a circle to fit about a person's neck.

Another embodiment, a twisted embodiment 42, to serve as a bendable necklace 42, is illustrated, as it is being made, in FIG. 5, while still arranged in the initial planar configuration. It is composed of two basic embodiments 34, made long enough to be of a necklace length, and then they are twisted about one another. How they appear in cross-section is shown in FIG. 6. One wire 38 is selected as the bendable metal 37 in each embodiment 34. Then, how they appear, after this bendable necklace 42 embodiment has been formed into a circle to fit about a person's neck, is illustrated in FIG. 7.

Figure 8:
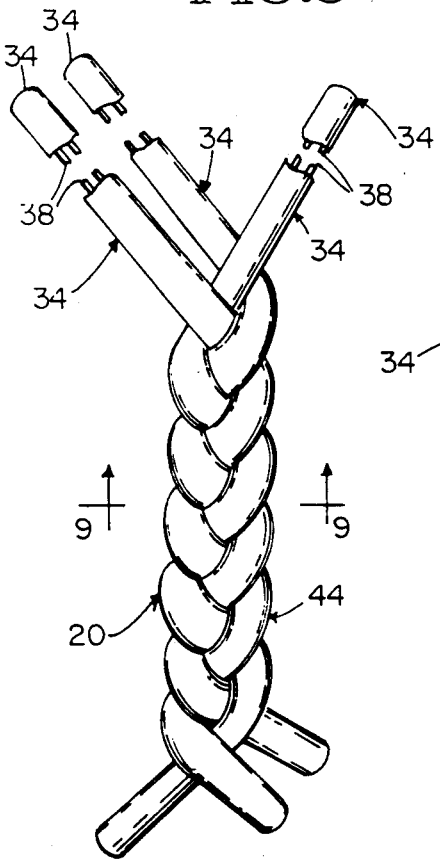
FIG. 8 illustrates how a bendable belt is being made in a planar configuration, as three basic embodiments are being braided together, indicating how in this embodiment, two wires are used in each basic embodiment.
Figure 9:
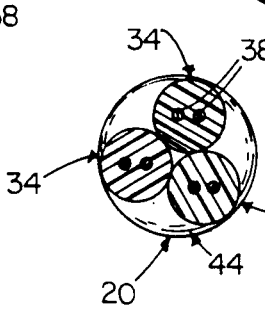
FIG. 9 shows the cross-section taken on line 9—9 of FIG. 8 of the bendable belt shown in FIG. 8, as it is being made.
Figure 10:
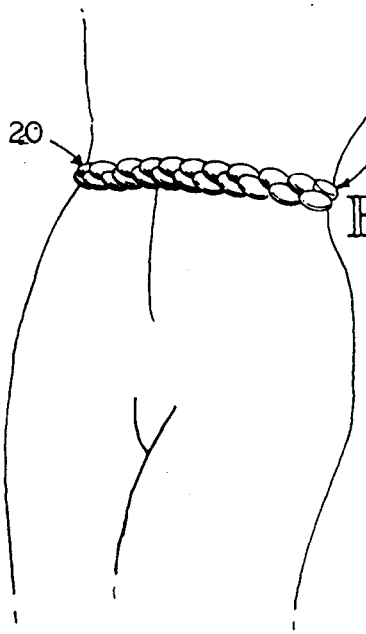
FIG. 10 shows how the bendable belt of FIGS. 8 and 9 has been formed into a circle to fit about a person's waist.

Another embodiment, a braided embodiment 44, to serve as a bendable belt 44, is illustrated, as it is being made, in figure 8, while still being arranged in an initial planar configuration, as three basic embodiments 34 are being braided together. How they appear in cross-section is shown in FIG. 9. Two wires are selected as the bendable metal 37, in each embodiment 34. Then how they appear, after this bendable belt 44 embodiment has been formed into a circle to fit about a person's waist, is illustrated in FIG. 10.

Figure 11:
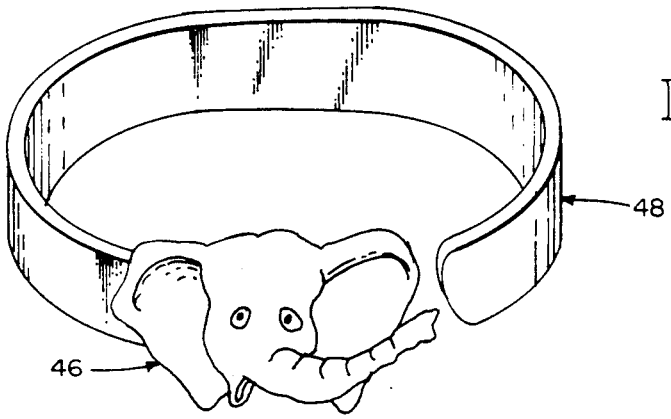
FIG. 11 illustrates how a bendable bracelet includes an ornament.

In many embodiments an ornament 46 may be molded in place, being made of the same rubber or rubber like material 40, or other material, as illustrated in reference to the bendable bracelet 48, having an ornament 46, as illustrated in FIG. 11.

Figure 12:
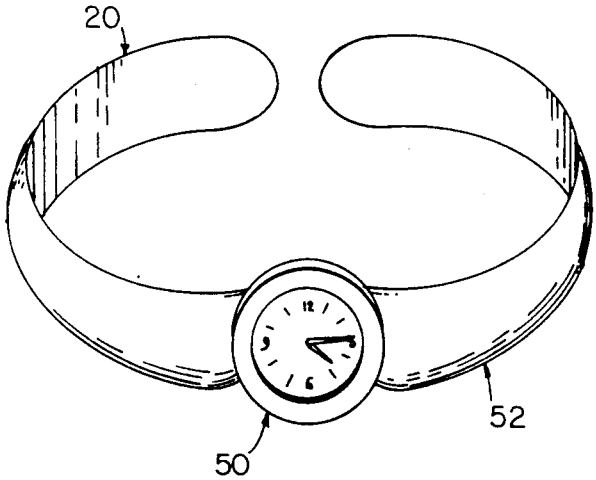
FIG. 12 shows how a bendable bracelet includes a molded in place watch.

A watch 50 is molded in place in a bendable bracelet 52 as shown in FIG. 12.

Figure 13:
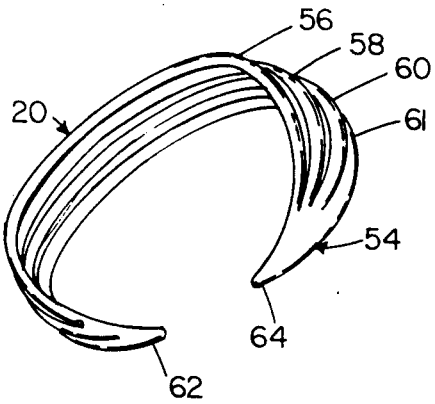
FIG. 13 illustrates how a bendable bracelet includes four bendable portions spaced apart until reaching each end where they are molded together.

Another embodiment 54, includes four bendable portions 56, 58, 60 and 61, which are spaced apart until reaching each end 62, 64, where they are molded together, as illustrated in FIG. 13. If made smaller a bracelet is formed, and if made larger a necklace is formed.

Figure 14:
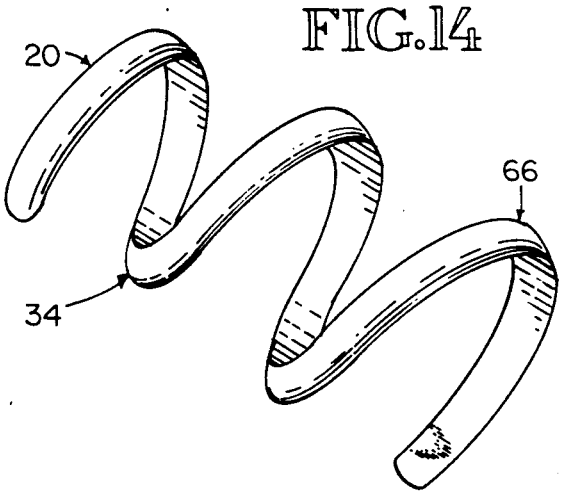
FIG. 14 illustrates how the bendable jewelry is arranged in a spiral configuration, which is later capable of being formed in a circle.

Spiral embodiments 66 are formed as shown in FIG. 14, and then, when spiralled, they are arranged in a circle form. If made smaller a bracelet is formed, and if made larger a necklace is formed.

Special embodiments 68, such as the necklace embodiment 68, are formed, for example, to represent beads 70 on a string 72. Also a jewel 74 is molded in place, as shown in FIG. 15.

Some embodiments 76 serve two purposes, as illustrated in FIG. 16, where a necklace 76, commencing in one encirclement, by wrapping it around twice to a smaller diameter, becomes a bracelet 22.

As described, all embodiments of this bendable jewelry 20, are comparatively easily manipulated, even when a person's hands and fingers have less dexterity, caused by rheumatoid arthritis, as illustrated in FIG. 17, when, for example, a bracelet 22 or 24 is being placed about one's wrist.

All these illustrated embodiments, of this bendable jewelry 20, and many more that are creatively manufactured and thereafter creatively arranged, serve all persons of all ages, having a wide range of finger and hand dexterity, to enable them to enjoy wearing comfortable, colorful, and fashionable jewelry, which they themselves put on and take off, without seeking the assistance of other persons.

The respective cross-sections of the bendable metal 38, which are selectable, are preferably circular 78, as illustrated. Elliptical, square, and/or rectangular cross-sections, not illustrated, might be considered. However, their selection will depend on how the respective embodiment or embodiments of the bendable jewelry 20 are to be manipulated by the persons into various jewelry embodiments of bracelet, necklace, belt, etc.

The respective overall cross-sections of the bendable jewelry 20 embodiments are selected from many embodiments, such as elliptical, rectangular, square, circular, with respect to the various possible embodiments. Within the possible range of manufacture there are many selected overall embodiments.

Some of the possible rubber material and rubber-like plastic materials currently available are: butyl rubber, also referred to as isobutene-isoprene; SBR, also referred to as styrene butadiene; and isoprene materials.

At this time the bendable metal which serves very well is available hay baling wire. Other bendable metals in various cross sections may be made available.

The overall purpose is the provision of bendable jewelry, having no fasteners, and easily manipulated by all persons, even those lacking dexterity in their fingers and hands, giving them the opportunity to create and to enjoy many styles of jewelry with ease, comfort, and fashion. This bendable jewelry is simple, safe, pliable, non toxic, readily cleaned, essentially non breakable, and reusable and reformable, taken off and put on, for many wearing times.

I claim:

1. An elongate, bendable, claspless jewelry which can be easily reshaped by the wearer into varied configurations comprising:

a) a pliable, elastomeric body having a first end, second end and central portion longitudinally extending therebetween;

b) said central portion comprising a first arcuate surface extending along the length of said body and a second planar surface including first and second edges extending along the length of said body;

c) said first arcuate surface extends from said first edge to said second edge of said planar surface;

d) at least one bendable, self-supporting length of core wire embedded and centrally disposed within said central portion of said body from said first end to said second end; and, e) said core wire including bent end portions positioned in said central portion adjacent said first and second ends of said body to significantly prevent exposure of said core wire through said body.

2. Bendable jewelry, as claimed in claim 1, combined with another bendable jewelry by twisting to create overall bendable jewelry.

3. Bendable jewelry, as claimed in claim 1, combined with at least two other bendable jewelry by braiding to create overall bendable jewelry.

4. Bendable jewelry, as claimed in claim 1, having, in addition, a watch member held in position by the elastomeric body.

5. Bendable jewelry, as claimed in claim 1, having in addition, a jewel member held in position by the elastomeric body.

6. Bendable jewelry, as claimed in claim 1, having the core wire formed with a circular cross-section.

7. Bendable jewelry, as claimed in claim 1, having the core wire formed with easily bendable square cross-sections, in reference to the arc of bending, such a bending about a person's wrist.

8. Bendable jewelry, as claimed in claim 1, wherein the elastomeric body is butyl rubber.

9. Bendable jewelry, as claimed in claim 1 wherein the elastomeric body is styrene butadiene.

10. Bendable jewelry, as claimed in claim 1 wherein the core wire is hay bailing wire.

11. Bendable jewelry, as claimed in claim 1, formed as a bracelet.

12. Bendable jewelry, as claimed in claim 1, formed as a necklace.

13. Bendable jewelry, as claimed in claim 1, formed as a belt.

14. Bendable jewelry, as claimed in claim 1, wherein coloring pigments are added to the elastomeric body to create a colorful appearance of this bendable jewelry.

15. Bendable jewelry as recited in claim 1, and further comprising:

a) a second bendable length of core wire embedded and centrally disposed within said central portion of said body from said first end to said second end and extending parallel to said at least one bendable length of core wire.

* * * * *